US008308020B2

(12) United States Patent
Davis et al.

(10) Patent No.: US 8,308,020 B2
(45) Date of Patent: Nov. 13, 2012

(54) SHIPPING DEVICE AND RELATED METHODS

(75) Inventors: Graham Davis, Glendora, NJ (US); Frederick A. Moyer, Troy, OH (US); Thomas A. Petrilli, Voorhees, NJ (US); Steven A. Wilson, Marlton, NJ (US); Thomas O'Malley, Pennsauken, NJ (US)

(73) Assignee: Honda Motor Co., Ltd., Tokyo (JP)

( * ) Notice: Subject to any disclaimer, the term of this patent is extended or adjusted under 35 U.S.C. 154(b) by 240 days.

(21) Appl. No.: 12/701,742

(22) Filed: Feb. 8, 2010

(65) Prior Publication Data

US 2010/0206894 A1 Aug. 19, 2010

Related U.S. Application Data

(60) Provisional application No. 61/152,418, filed on Feb. 13, 2009.

(51) Int. Cl.
*B65D 25/04* (2006.01)
*B65D 90/00* (2006.01)

(52) U.S. Cl. ..... 220/694; 220/530

(58) Field of Classification Search ..... 220/9.4, 220/529, 530, 694; 410/97, 117, 118; 224/486; 280/749

See application file for complete search history.

(56) References Cited

U.S. PATENT DOCUMENTS

| | | | | |
|---|---|---|---|---|
| 2,018,605 | A | 10/1935 | Craig | |
| 3,552,613 | A * | 1/1971 | Nye | 224/406 |
| 4,685,571 | A | 8/1987 | Hoss | |
| 4,884,935 | A | 12/1989 | Smith et al. | |
| 5,056,665 | A | 10/1991 | Boecker et al. | |
| 5,388,702 | A * | 2/1995 | Jones | 206/597 |
| 5,725,119 | A | 3/1998 | Bradford et al. | |
| 6,543,659 | B2 * | 4/2003 | Blair | 224/404 |
| 6,783,311 | B2 * | 8/2004 | Sauerwald | 410/97 |
| 6,821,600 | B1 * | 11/2004 | Henson | 428/99 |
| 6,935,819 | B2 * | 8/2005 | Squyres | 410/104 |
| 2006/0278646 | A1 | 12/2006 | Bradford | |
| 2008/0135546 | A1 | 6/2008 | Smith et al. | |

* cited by examiner

*Primary Examiner* — Harry Grosso

(74) *Attorney, Agent, or Firm* — Donald Stevens; Emerson Thomson Bennett

(57) ABSTRACT

A containment assembly may be used with a shipping container and may include: a cargo net having a pair of sleeves; and, a pair of tethering members that are received within the sleeves and that have ends that extends out from the sleeves. The ends of the tethering members may be attachable to multiple attachment surfaces on the shipping container to change the orientation of the cargo net with respect to the shipping container.

8 Claims, 6 Drawing Sheets

SHIPPING DEVICE AND RELATED METHODS

This application claims priority to U.S. Ser. No. 61/152,418,entitled SHIPPING DEVICE AND RELATED METHODS, filed Feb. 13, 2009,which is incorporated herein by reference.

I. BACKGROUND

A. Field of Invention

This invention relates to devices and methods for shipping cargo.

B. Description of the Related Art

It is known in the shipping arts to use carts and/or cages in a warehouse environment for gathering parts or other cargo for shipment. Furthermore it is known to box the parts in corrugated cardboard, with packing materials, to protect fragile parts from damage during transport and handling. Previous attempts to protect fragile parts included placing fragile parts in cardboard boxes while on the cart, and then loading the cart and all its contents for shipment.

The present invention provides devices and systems that differ from the prior art and that may overcome one or more of the shortcomings thereof.

II. SUMMARY

According to one embodiment of this invention, a containment assembly for use with an associated shipping container may comprise: a cargo net having first and second sleeves and a cargo supporting surface that supports associated cargo to the associated shipping container; a first tethering member that is received within the first sleeve and that has a first end that extends out from the first sleeve; and, a second tethering member that is received within the second sleeve and that has a first end that extends out from the second sleeve. The first end of the first tethering member and the first end of the second tethering member may be attachable to a plurality of attachment surfaces on the associated shipping container to change the orientation of the cargo net with respect to the associated shipping container.

According to another embodiment of this invention, a shipping system may comprise: (1) a shipping container comprising: a base having a cargo supporting surface that supports relatively heavier associated cargo; a first wall supported to and extending from the base; and, a second wall supported to and extending from the base; and, (2) a containment assembly comprising: a cargo net having first and second sleeves and a cargo supporting surface that supports relatively lighter associated cargo; a first tethering member that is received within the first sleeve and that has a first end that extends out from the first sleeve; and, a second tethering member that is received within the second sleeve and that has a first end that extends out from the second sleeve. The first end of the first tethering member and the first end of the second tethering member may be attachable to a plurality of attachment surfaces on the first and second walls to change the orientation of the cargo net with respect to the shipping container.

According to yet another embodiment of this invention, a method may comprise the steps of: (A) providing a shipping container having a plurality of attachment surfaces; (B) providing a containment assembly comprising: a cargo net having first and second sleeves and a cargo supporting surface; a first tethering member that is received within the first sleeve and that has a first end that extends out from a first end of the first sleeve and a second end that extends out from a second end of the first sleeve; and, a second tethering member that is received within the second sleeve and that has a first end that extends out from a first end of the second sleeve and a second end that extends out from a second end of the second sleeve; (C) evaluating a first cargo set; (D) attaching the first and second ends of the first tethering member to first and second attachment surfaces on the shipping container and the first and second ends of the second tethering member to third and fourth attachment surfaces on the shipping container to support the cargo net in a first orientation with respect to the shipping container to match the first cargo set; and, (E) placing the first cargo set on the cargo supporting surface.

One advantage of this invention is that the use of corrugated cardboard in shipping cargo, and the resulting trash, can be eliminated in many cases.

Another advantage of this invention is that cargo damage can be minimized.

Another advantage of this invention is that production steps and time related to shipping can be shortened.

Still another advantage of this invention is that shipping costs can be reduced.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
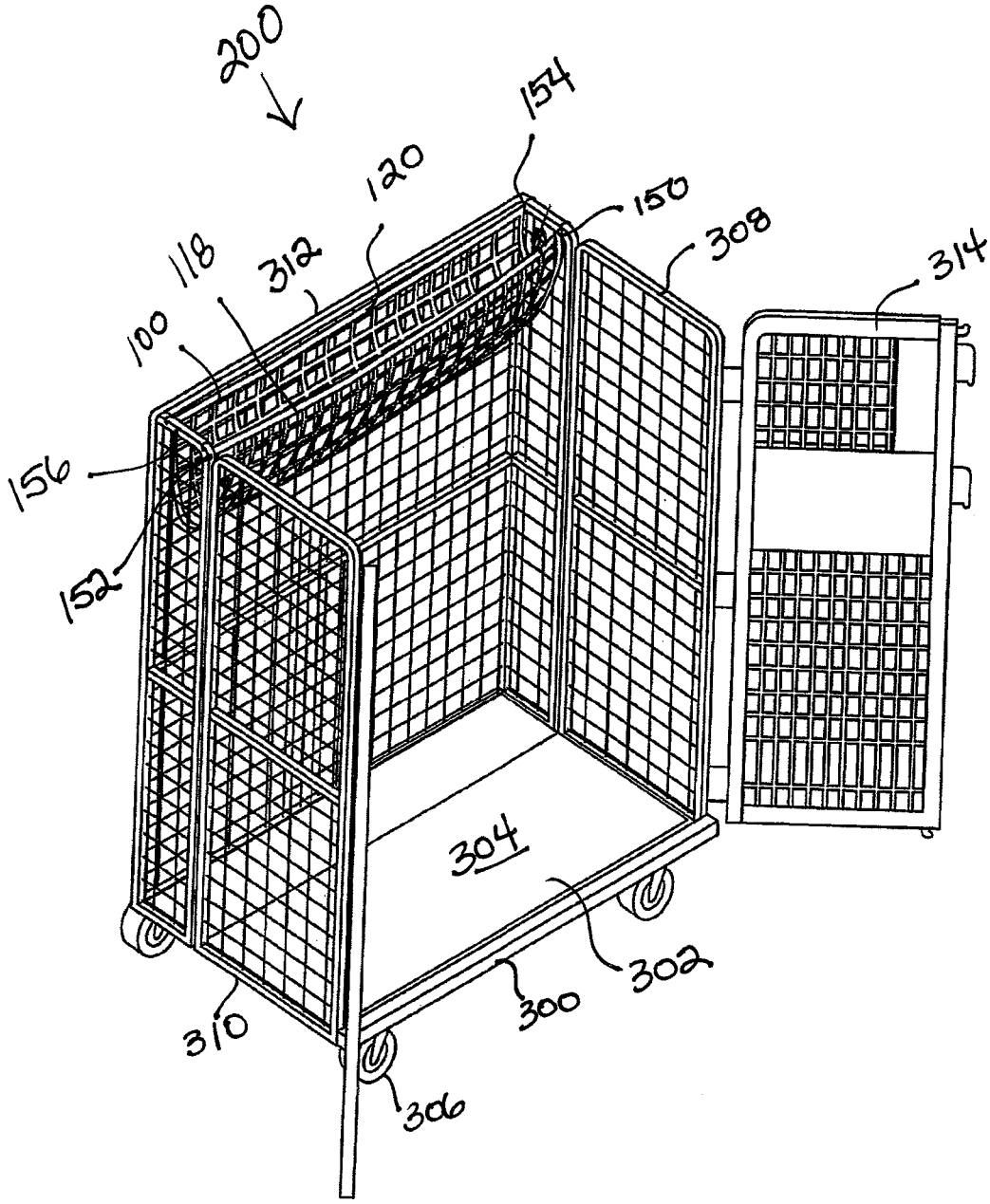
FIG. 1 is top perspective view of a shipping system with a containment member in a first relative orientation.
Figure 2:
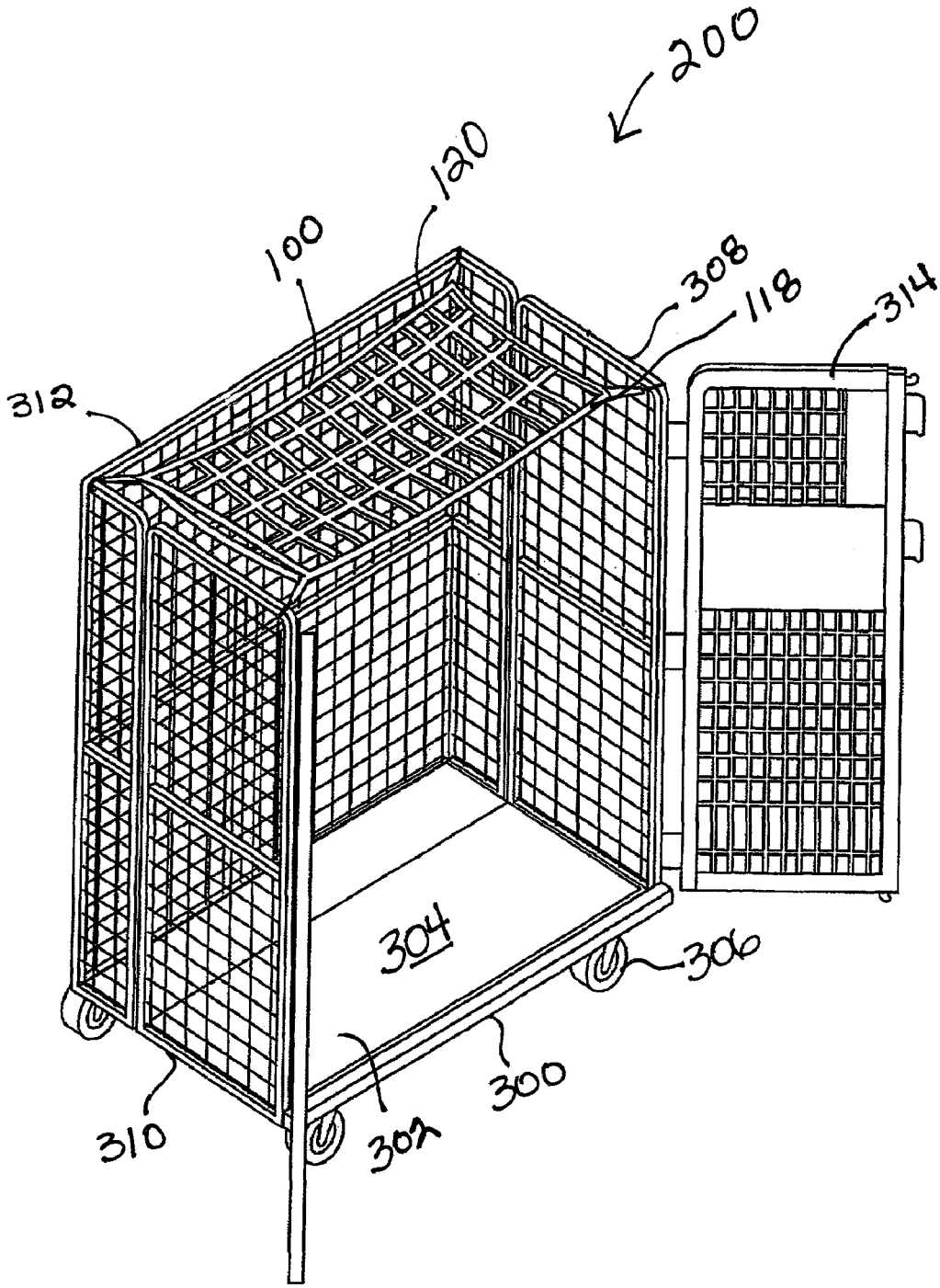
FIG. 2 is a view similar to that shown in FIG. 1 but with the containment member in a second relative orientation.
Figure 3:
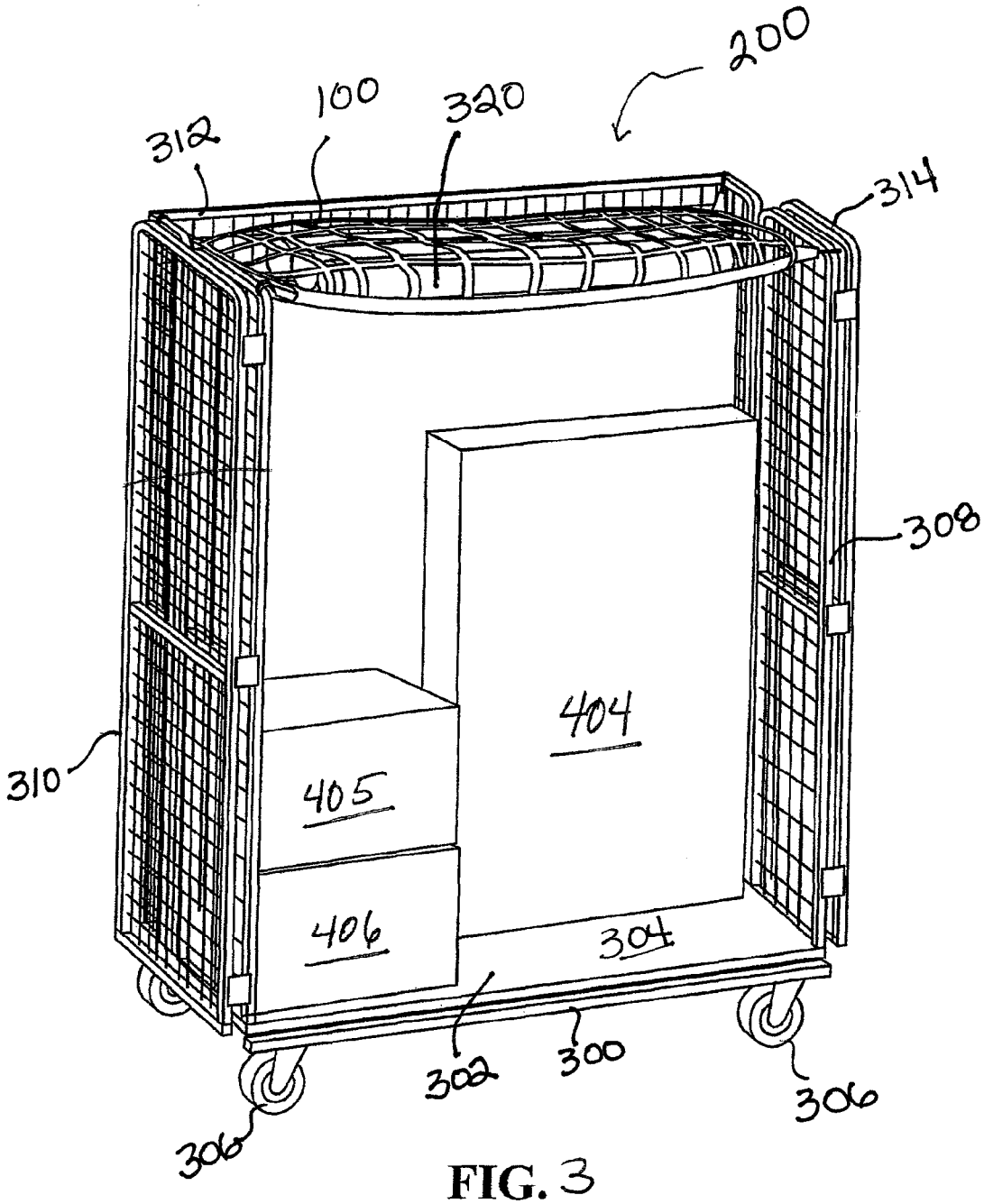
FIG. 3 is front perspective view of a shipping system with cargo shown supported to the base of the shipping container.
Figure 4:
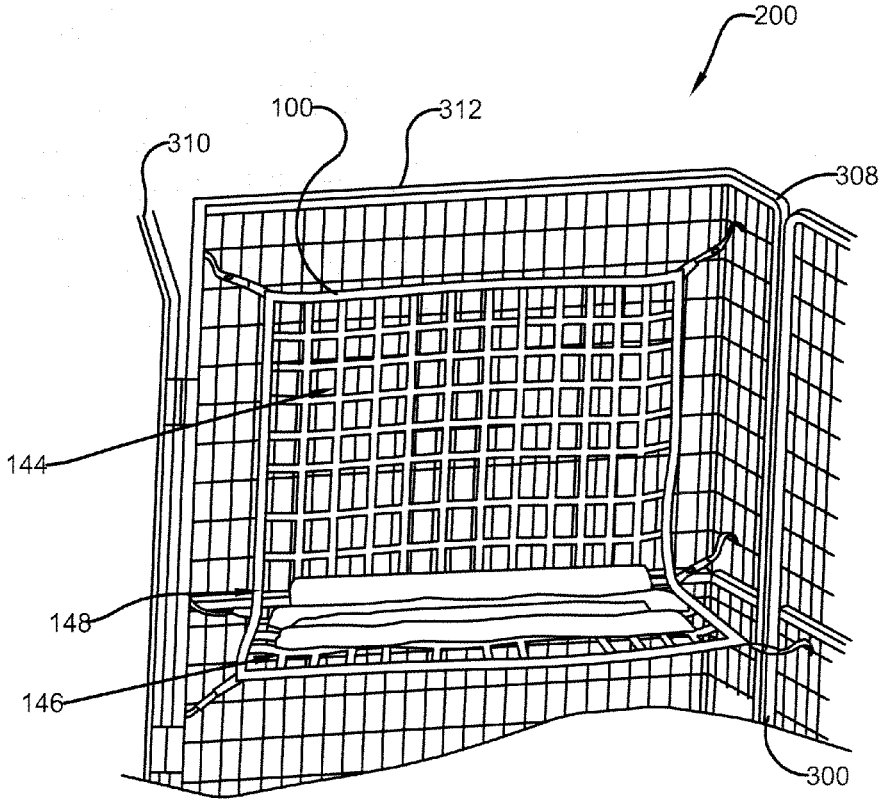
FIG. 4 is a close up view of a containment member in an L-shaped configuration with respect to the shipping container.

Referring now to the drawings wherein the showings are for purposes of illustrating embodiments of the invention only and not for purposes of limiting the same, FIG. 1 is a top perspective view of a shipping system 200 according to one embodiment of this invention. The shipping system 200 may be used to ship or transfer cargo of any style and shape chosen with the sound judgment of a person of skill in the art. In one embodiment shown in FIG. 3, the shipping system 200 may be used to ship both relatively larger and/or heavier and/or durable cargo items, such as those shown with reference numbers 404, 405, 405, and relatively smaller and/or lighter and/or fragile cargo items, such as shown with reference numbers 320. In one specific embodiment, the relatively smaller and/or lighter and/or fragile cargo items may be automotive moldings. The shipping system 200 may include a shipping container 300 and a containment assembly 100. The containment assembly 100 can be orientated with respect to the shipping container 300 in numerous ways. In FIG. 1, for example, the containment assembly 100 is in a vertical U-shaped orientation. In FIGS. 2 and 3 the containment assembly 100 is in a horizontal folded orientation. In FIG. 4 the containment assembly 100 is in an L-shaped orientation. It should be understood that these are examples only as the containment assembly 100 can be orientated with respect to the shipping container 300 in any manner chosen with the sound judgment of a person of skill in the art.

With reference now to FIGS. 1-4, the shipping container 300 can be of any style and shape chosen with the sound judgment of a person of skill in the art. In one embodiment, the shipping container 300 may have a base 302 with a cargo supporting surface 304. The cargo supporting surface 304, for the embodiment shown, is well suited to support relatively larger and/or heavier and/or durable cargo items, such as those shown with reference numbers 404, 405, 405. One or more wheels 306 may be attached to the bottom of the shipping container 300 so it can be rolled from place to place to transfer cargo. The shipping container 300 may also have walls extending from the base 302. For the embodiment shown, the shipping container 300 has two side walls, 308, 310 and a back wall 312. The number, size and style of walls can be any chosen with the sound judgment of a person of skill in the art. For the embodiment shown, they are formed with openings so the shipping container 300 may be considered a cage. The shipping container 300 shown has numerous attachment surfaces. By "attachment surface" it is meant any surface or portion of the shipping container 300 to which the containment member 100 can be attached. This will be discussed further below. The front and top may be open, as shown. A door 314 may be used to cover a portion of the front. The door 314 may have hinges so it can easily be moved between open and closed positions. As the general construction and use of a shipping container 300 is well known to those of skill in the art, further details will not be provided here.

Figure 5:
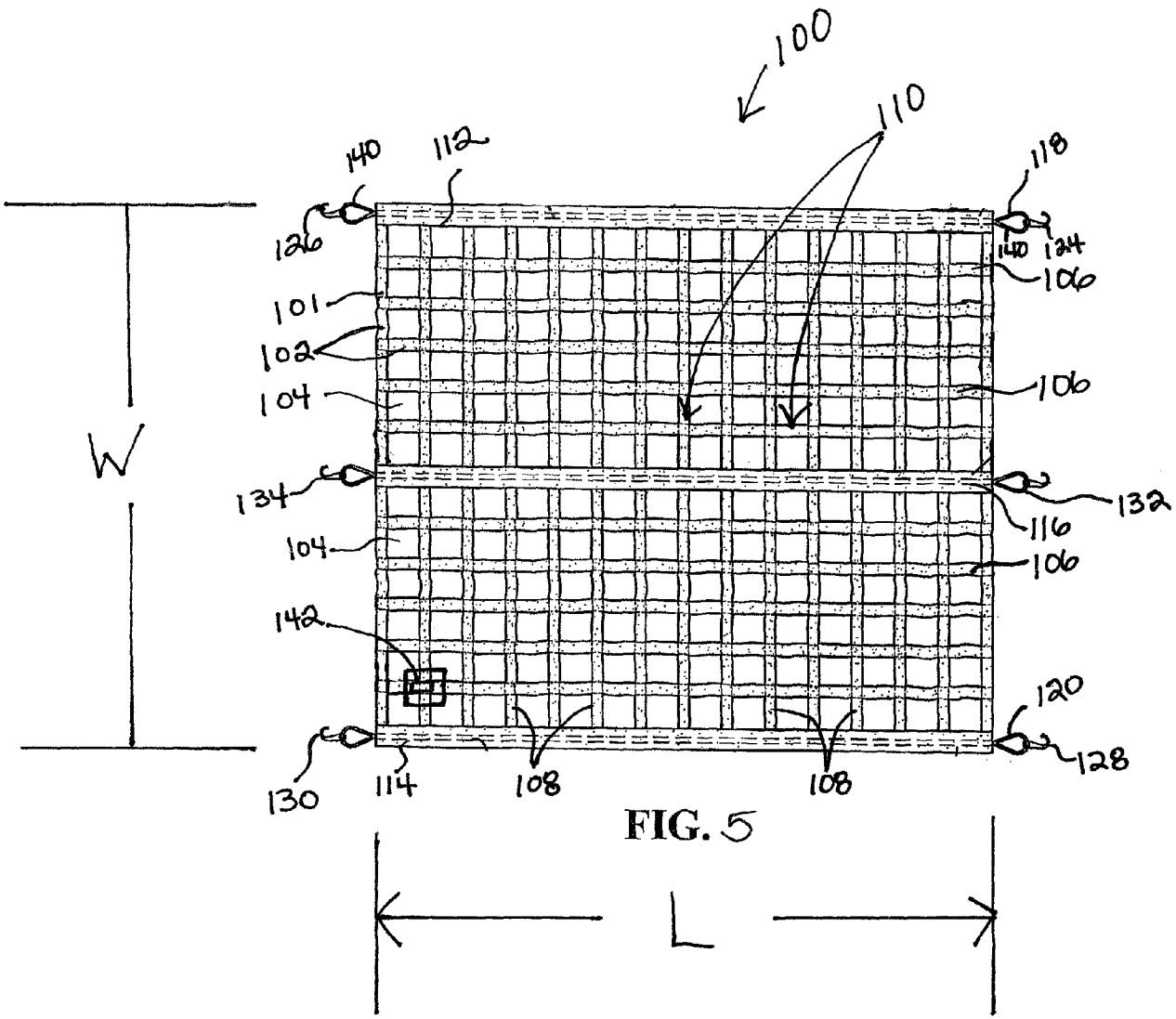
FIG. 5 is a top view of a containment member.

With reference now to especially to FIG. 5, the containment assembly 100 can be of any style and shape chosen with the sound judgment of a person of skill in the art to support, wrap around, and/or envelope cargo that it contains. In one embodiment, the containment assembly 100 includes a cargo net 101. By "net" it is meant that it is meshed, having portions of material 102 and portions of open space 104. The cargo net 101 may be formed of a plurality of substantially parallel first straps 106 and a plurality of substantially parallel second straps 108 that are substantially perpendicular to the first straps 106. According to the embodiment shown in FIG. 5, the first straps 106 and second straps 108 are affixed to each other by stitching. The cargo net 101 may have a cargo supporting surface 110. For the embodiment shown, the cargo supporting surface 110 is well suited to support relatively smaller and/or lighter and/or fragile cargo items. The cargo net 101 can be of any style and shape chosen with the sound judgment of a person of skill in the art. For the embodiment shown, it is generally rectangular in shape having a width W and a length L. The cargo net 101, for some non-limiting examples, may be formed of one or more of woven elastomeric fabrics, woven nylon fabrics, woven cotton fabrics, fiber reinforced polymer sheets and the like. The cargo net 101 may have at least one sleeve attached thereto. For the embodiment shown, the cargo net 101 has two relatively outward sleeves, 112, 114 and a third sleeve 116 positioned between the outward sleeves 112, 114. The sleeves 112, 114, 116 may be substantially parallel, as shown, though other spatial arrangements are also possible. The sleeves 112, 114, 116 may be attached to the cargo net 101 in any manner chosen with the sound judgment of a person of skill in the art, such as by stitching. Each sleeve 112, 114, 116 may have an opening along at least a portion of its length. For the embodiment shown, each sleeve 112, 114, 116 has an opening along its entire length—from one end to the opposite end.

With continuing reference to FIG. 5, the containment assembly 100 may also include at least one tethering member that is used to attach the cargo net 101 to the shipping container 300. The number, style and shape of tethering members, and the manner in which they are attached to the cargo net 101 may be any chosen with the sound judgment of a person of skill in the art. In one embodiment the tethering member can be slid with respect to the corresponding sleeve (such as within the opening in the sleeve) and in other embodiment a portion of the tethering member may be attached to the sleeve, for instance, by stitching or other suitable means. For the embodiment shown, there is one tethering member 118, 120, 122 for each sleeve. Specifically, tethering member 118 is received within the opening of the sleeve 112, tethering member 120 is received within the opening of the sleeve 114, and tethering member 122 is received within the opening of the sleeve 116. Each end of the tethering member may extend out of the corresponding end of the sleeve, as shown. It is also contemplated, however, to use a tethering member that extends only out of one end of a sleeve. It is also contemplated to use two or more tethering members with a single sleeve. In one specific embodiment, one tethering member may extend from one end of a sleeve while another tethering member may extend from the opposite end of the same sleeve. A tethering member, for some non-limiting examples, may be formed of one or more of a bungee cord, an elastomeric cord, a rope, a string, a wire, or a cable.

Figure 6:
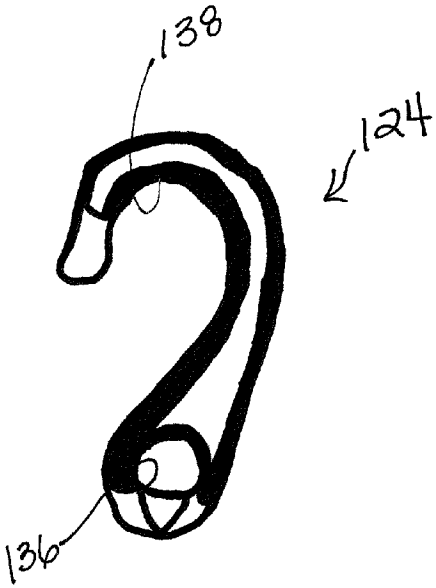
FIG. 6 is a top view of a fastener.

With reference now to FIGS. 1-6, at least one end of a tethering member may be attachable to a plurality of attachment surfaces on the shipping container 300. In one embodiment, a fastener may be attached to the end of a tethering member and the fastener may then be attachable to a plurality of attachment surfaces on the shipping container 300. In one embodiment, shown, a separate fastener 124, 126, 128, 130, 132, 134 is attached to each end of each tethering member 118, 120, 122, respectively. Each fastener can be of any style and shape chosen with the sound judgment of a person of skill in the art. FIG. 6 shows one embodiment of a fastener 124 having one end with an aperture 136 and another end with a hook 138. The aperture 136 may receive a portion of the tethering member, such as loop 140, and the hook 138 may then be easily attached to any of the attachment surfaces on the shipping container 300. It should be noted that, depending on the particular design of the shipping container 300, there may be limited or nearly unlimited attachment surfaces. For the embodiments shown, the hook 138 can easily be attached to any of numerous surfaces on any of the walls 308, 310, 312 that form the numerous openings on the shipping cage 300. Other non-limiting examples of fasteners that can be used with this invention include a swivel, an eyelet, a carabiner, a clip, and the like, or any combination thereof.

With reference now to FIGS. 1 and 5, the containment assembly 100 may also include an identification member 142. The identification member 142 may be used, for non-limiting examples, to identify and/or track the containment assembly 100 and/or the shipping container 300 and/or the shipping system 200 and/or the cargo being shipped. The identification member 142 can be of any style and shape chosen with the sound judgment of a person of skill in the art. The identification member 142 may contain, for some non-limiting examples, a bar code, an RFID (Radio-Frequency Identification) tag, a visible serial number, or the like. In one embodiment the identification member 142 may be somewhat permanently stitched onto the containment assembly 100, or in other cases it may be removeably attached to the containment assembly 100, such as being inserted into a pocket.

FIGS. 1-4, show the containment assembly 100 oriented into various advantageous configurations. For example, FIG. 1 shows the containment assembly 100 oriented into a vertical U-shaped or hammock configuration wherein the containment assembly 100 opens in an upward direction to store cargo in a cradling relation. For this example the following attachment surfaces 150, 152, 154, 156 to which the containment net 101 is attached are at substantially the same height. In this case the tethering members 118, 120 are separated by a distance of not more than 0.25 W (as noted above, W is the width W of the containment assembly 100). Though not shown, fasteners at the bottom of the U may be used in conjunction with fasteners at the top ends to attach the containment assembly 100 to the shipping cage 300. In FIG. 2, the containment assembly 100 is in a horizontal planar relation to the shipping cage 300. In this case the tethering members 118, 120 are separated by a distance of at least 0.4 W. Such a configuration can, for instance, serve as an enclosure for parts to be placed toward the top of the cage and out of the way of parts toward the bottom of the cage. This may be especially advantageous where large, heavier parts are positioned toward the bottom of the cage and fragile, lighter parts are stored in the containment assembly 100, as the heavier parts will not be able to interfere with or damage the fragile parts. Research has shown that in contrast to heavy packaging of fragile parts, placing the fragile parts in a containment assembly 100 that is out of the way of other parts may reduce damage rates of fragile parts, such as automotive moldings. Damage may be particularly important to avoid for automotive moldings as the aesthetic appearance of the moldings may be just as important as its functional aspects, such that dings or scratches to a molding may make a molding useless, whereas dings or scratches to a less-cosmetic part, such as a brake master cylinder might not affect the ability to still use and/or sell the brake master cylinder.

As shown in FIG. 3, the containment assembly 100 is oriented similar to the configuration shown in FIG. 2. In this example the containment assembly 100 can be used to provide a shelf above a lower displaced base 302 in the shipping cage 300, or to provide support for stabilizing large cargo items 404, 405, 405 which can be stored on the shipping cage 303 below the containment member. Also, the containment assembly 100 can be displayed across (not shown) the front opening of the shipping cage 300 to operate as a flexible door that can be selectively opened and which can cushion the contents 404, 405, 406 of the shipping cage 300 during shipping or storage. As shown in FIG. 4, the containment assembly 100 can be folded at a 90 degree angle, forming an L-shape, with fasteners to various parts of the cage, to form a shelf-like configuration, comprising a back portion 144, a seat portion 146, and a spine 148. In the illustrated embodiment, the area of the back portion 144 and the seat portion 146 is approximately equal, although this is not necessary and the relative size of each portion may be modified to fit the dimensions of the associated parts being moved and need of the operator. One of skill in the art will recognize that 90 degree shelf configuration shown in FIG. 4 may be tilted at various angles so that the 90 degree orientation is maintained but the seat portion 146 is no longer parallel to the floor (not shown). Furthermore, the 90 degree angle shown in FIG. 4 may be configured to be other than 90 degrees. For example, the angle between the back 144 and the seat portion 146 might be an acute angle, if that better fit the parts and the need of the operator. Advantageously, elastic characteristics of tether members may assist with providing a taut shelf-like configuration of the container member to assist with loading and unloading of parts from the container and to avoid tangling of parts in the container member.

With reference now to all the FIGURES, one embodiment of the operative method will be disclosed. A part or parts (referred to here as a first cargo set) is evaluated. Some parts, either fragile parts, or awkwardly configured parts, or parts that are generally difficult to box and pack create challenges. Correctly packaging such parts requires relatively expensive packing and time to do so. The cardboard and other packing materials create waste, which hurts the environment, raises the cost of the parts, and fills trash containers and landfills. Advantages are obtainable by using the disclosed method and apparatus, in that all parts are reusable, create less waste, are cheaper, and are easier to use. The method has been especially adaptable to plastic moldings as used in the manufacture of vehicles, or when such moldings need to be shipped from a central or first location (such as the vehicle manufacturer's warehouse) to body shops and car dealers (a second, remote location). Once the first cargo set is evaluated, the containment assembly 100 is attached to the shipping container 300 in a manner to match the first cargo set. Non-limiting examples of the manner in which the containment assembly 100 may be attached to the shipping container 300 are described in the previous paragraphs. It should be understood that in some cases the cargo set may be first placed onto the cargo supporting surface 110 and then the containment assembly 100 may be attached to the shipping container 300. In other cases, however, the containment assembly 100 may be first attached to the shipping container 300 and then the cargo set may be placed onto the cargo supporting surface 110. One or more identification members 142 may be used in any manner known to those of skill in the art. The containment assembly 100 can be easily re-oriented as needed and can be reused with other parts (referred to here as a second or larger cargo set).

Numerous embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

Having thus described the invention, it is now claimed:

We claim:

1. A shipping system comprising:

a shipping container cart or cage used within a warehouse comprising:

a base having a cargo supporting surface that supports relatively heavier associated cargo;

a first wall supported to and extending from the base; and, a second wall supported to and extending from the base;

a containment assembly comprising:

a cargo net having first and second sleeves and a cargo supporting surface that supports relatively lighter associated cargo;

a first tethering member that is received within the first sleeve and that has a first end that extends out from the first sleeve; and, a second tethering member that is received within the second sleeve and that has a first end that extends out from the second sleeve;

wherein the first end of the first tethering member and the first end of the second tethering member are attachable to a plurality of attachment surfaces on the first and second walls to change the orientation of the cargo net with respect to the shipping container;

wherein at least a portion of the cargo supporting surface of the cargo net is positioned substantially horizontal and substantially parallel to the cargo supporting surface of the base; and, wherein the portion of the cargo supporting surface of the cargo net that is positioned substantially horizontal and parallel to the cargo supporting surface of the base, supports the relatively lighter associated cargo above the base.

2. The shipping system assembly of claim 1 wherein:

the first and second sleeves each have first and second ends;

the first end of the first tethering member extends out from the first end of the first sleeve;

the first tethering member has a second end that extends out from the second end of the first sleeve;

the first end of the second tethering member extends out from the first end of the second sleeve;

the second tethering member has a second end that extends out from the second end of the second sleeve; and, wherein the second end of the first tethering member and the second end of the second tethering member are attachable to a plurality of attachment surfaces on the first and second walls to change the orientation of the cargo net with respect to the shipping container.

3. The shipping system of claim 2 further comprising:

a first fastener that is attached to the first end of the first tethering member and that is attachable to a plurality of attachment surfaces on the first and second walls;

a second fastener that is attached to the first end of the second tethering member and that is attachable to a plurality of attachment surfaces on the first and second walls;

a third fastener that is attached to the second end of the first tethering member and that is attachable to a plurality of attachment surfaces on the first and second walls; and, a fourth fastener that is attached to the second end of the second tethering member and that is attachable to a plurality of attachment surfaces on the first and second walls.

4. The shipping system of claim 3 wherein:

the first and second sleeves are substantially parallel and are on opposite ends of the cargo net;

the cargo net has a third sleeve that is substantially parallel to and positioned between the first and second sleeves and that has first and second ends;

a third tethering member is received within the third sleeve and has a first end that extends out from the first end of the third sleeve and a second end that extends out from the second end of the third sleeve; and, the first end of the third tethering member is attachable to a plurality of attachment surfaces on the first and second walls to change the orientation of the cargo net with respect to the shipping container.

5. The shipping system of claim 4 wherein the cargo net comprises:

a plurality of substantially parallel first straps that are substantially parallel to the first, second and third sleeves;

a plurality of substantially parallel second straps that are substantially perpendicular to the first, second and third sleeves; and, an identification member attached to the cargo net and unique to the cargo net, wherein the identification member identifies at least one of the shipping system, the shipping container, the containment assembly, the relatively heavier associated cargo and the relatively lighter associated cargo.

6. The shipping system assembly of claim 1 wherein the cargo net is arranged with respect to the base to define a vertical U-shape with the bottom of the U defining the portion of the cargo supporting surface of the cargo net that is positioned substantially horizontal and parallel to the cargo supporting surface of the base.

7. The shipping system assembly of claim 1 wherein substantially the entire cargo net is arranged with respect to the base to define a substantially planar shape that defines the portion of the cargo supporting surface of the cargo net that is positioned substantially horizontal and parallel to the cargo supporting surface of the base.

8. The shipping system assembly of claim 1 wherein the cargo net is arranged with respect to the base to define an L-shape with the bottom of the L defining the portion of the cargo supporting surface of the cargo net that is positioned substantially horizontal and parallel to the cargo supporting surface of the base.

* * * * *